US005816961A

United States Patent [19]

Kraemer

[11] Patent Number: 5,816,961

[45] Date of Patent: Oct. 6, 1998

[54] RATCHETING HOCKEY HANDLE

[76] Inventor: Clement L. Kraemer, 12881 Wheeler Pl., Santa Ana, Calif. 92705

[21] Appl. No.: 856,640

[22] Filed: May 15, 1997

[51] Int. Cl.[6] ..... A03B 59/14

[52] U.S. Cl. ..... 473/560; 473/552; 473/295

[58] Field of Search ..... 473/560, 561, 473/562, 563, 568, 526, 552, 295, 189

[56] References Cited

U.S. PATENT DOCUMENTS

| | | | |
|---|---|---|---|
| 4,101,125 | 7/1978 | Heath | 273/75 |
| 4,854,596 | 8/1989 | Carbonetti | 273/73 |
| 4,943,058 | 7/1990 | Carbonetti | 273/73 |
| 5,058,902 | 10/1991 | McCutchen | 273/73 |
| 5,257,782 | 11/1993 | Schicketanz | 273/73 |
| 5,263,711 | 11/1993 | Addis et al. | 473/562 |
| 5,409,216 | 4/1995 | Brown | 273/73 |
| 5,577,725 | 11/1996 | Pagotto et al. | 473/560 |
| 5,609,336 | 3/1997 | Tashjian | 473/560 |

FOREIGN PATENT DOCUMENTS

| | | | |
|---|---|---|---|
| 966164 | 4/1975 | Canada | 473/189 |

*Primary Examiner*—Mark S. Graham

*Attorney, Agent, or Firm*—Stetina Brunda Garred & Brucker

[57] ABSTRACT

A hockey stick with a handle that will permit rotation of its shaft to angularly orient its blade relative to a playing surface for elevational control over a hockey puck. All hockey players have different wrist, arm and shoulder variables. In order to align the stick to the player for more natural and even wrist rotation from the 12 o'clock position. It tailors the grip of the handle to the individual's actual anatomy. By using a ratchet system, it enables the handle to rotate to the lie of the player's wrist before being closed and locked into place.

2 Claims, 2 Drawing Sheets

RATCHETING HOCKEY HANDLE

FIELD OF THE INVENTION

The present invention relates to a hockey stick having a handle at the end of the shaft of the hockey stick to facilitate elevation control over a hockey puck being moved by the hockey stick.

BACKGROUND OF THE INVENTION

Prior art hockey sticks for hockey players are according to the rules for the game made up of a straight shaft no longer than sixty inches in length that has a twelve and one-half inch curved blade with a beveled edge. These rules further specify that the blade's curvature is restricted to be within one-half inch of a straight line from the heel to the toe of the blade. The goalie's hockey stick has different rules governing its appearance and construction which need not be considered in an understanding of this invention.

There is no known prohibition in the rules against allowing the blade and shaft to rotate such that the blade can assume various angles with the surface thereunder, nor has there been any attempt known prior to this invention to provide means integral with the hockey stick to permit a player to use a rotatable handle to rotate the stick's shaft and blade to provide blade to surface angle variation.

Many players who are experienced hockey players will attempt to lay-down or stand-up their hockey stick to advance, capture, control or shoot a puck toward a goal. In doing so it is very easy to err in the desired blade to puck relationship. With the adjustability of the blade to surface angular relationship afforded by this invention a player need not attempt to make numerous stick holding adjustments.

BACKGROUND ART

As stated above there is no known prior art in the specific field of this invention. There is on-the-other-hand various other tools of athletes that have provided for angular variation of a surface for striking tennis and golf balls. Representative of this prior art as regards means to vary the angle of the head portion about the axis of the handle are U.S. Pat. Nos. 4,101,125; 4,854,596; 4,943,058; 5,058,902; and 5,409,216. If one skilled in the art were to attempt to use these teachings to arrive at this invention, he or she would attempt to attach the blade to the shaft of the stick so that the former would rotate relative to the latter. This would create an area of weakness that would easily break upon blade contact with a puck.

In addition there are known means to vary golf head angle with a shaft of a golf club to permit one club to serve as a driver, an approach iron and a putter. In this known device there is an adjustable connection at the juncture of head and shaft that is structurally enhanced to allow for the force of the ball on the head to be absorbed without causing damage to the connection. It is not believed that one skilled in the art could bring such a construction to a hockey stick in view of the rules calling for one piece blade and shaft for hockey stick; nor, would the pace of the hockey game permit the mechanical adjustment of the blade in the known construction that requires a screwdriver to loosen and re-tighten the connection each time one desires a different golf head angle.

SUMMARY OF THE INVENTION

An object of the present invention is to allow the curved blade of a hockey stick to assume open and closed angles to establish means to facilitate more or less elevation in the trajectory of a hockey puck being propelled by a hockey stick.

Another object of this invention is to permit a hockey player to assume more control over advancing or shooting a hockey puck with a more upright attitude of the hockey stick.

A further object of this invention is to provide an adjustable blade angle means for a hockey stick that can be operated while a player is on the ice, so-to-speak without slowing the pace of the game.

A still further object of this invention is to provide angular variation means in a handle at the upper end of a shaft of a hockey stick that conforms to rules and regulations relative to hockey stick construction without adding mass or creating a stress point where the shaft turns into the blade surface.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
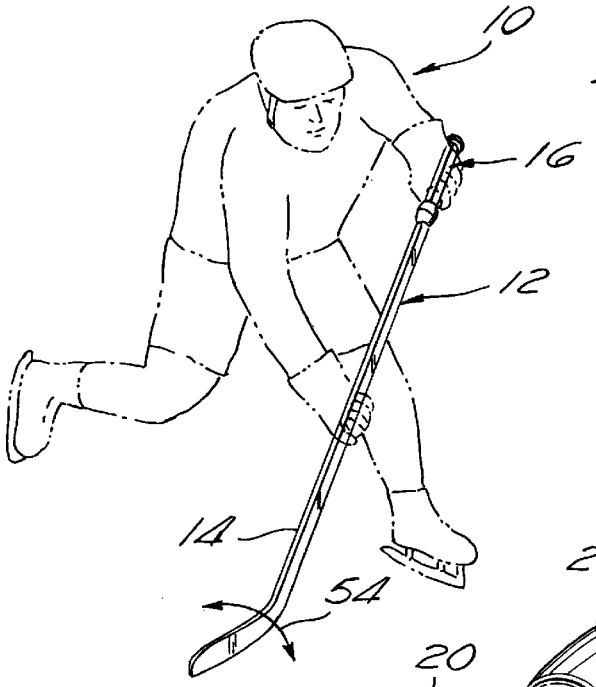
FIG. 1 is a sketch of hockey player outlined in phantom with a hockey stick constructed in accordance with this invention in hand.

With reference to FIG. 1 there is shown a hockey player 10 in phantom skating with a hockey stick 12 in hand. The hockey stick 12 is made of a hollow composite shaft element 14, a wood butt handle 16 and wooden blade.

Figure 2:
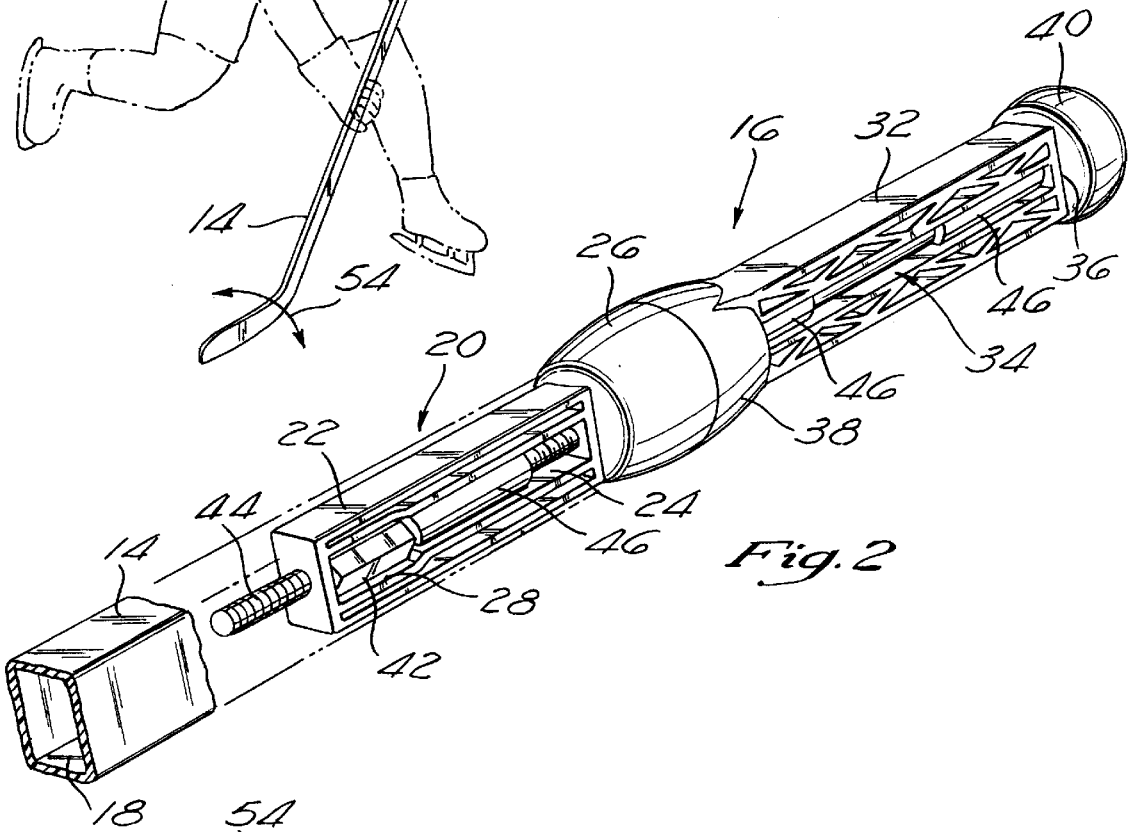
FIG. 2 is an exploded isometric view of the handle for a hockey stick constructed in accordance with this invention.

As seen in FIG. 2 the wood butt handle is removed so as to receive a mating end portion 20 of the handle 16. The composite shaft is then cut to proper length and the discarded piece of composite can be used to adapt the handle to a solid wood shaft. The added weight of the handle now changes the inertia point to the blade giving the player more velocity on his shot. End portion 20 is shaped or formed to have a long rectangular extension 22. The rectangular extension 22 is sized to fit tightly in any composite end 18 of the blade shaft element 14 and is preferably held thereto by any suitable adhesive known to those skilled in the art.

The handle 16 also includes a grip end or portion 32 of similar construction as mating end portion 20 so as to include a through channel 34 from its flat end 36 to its bell-like housing end 38.

The handle construction receives a one-inch coupling nut element 42 in the polygonal receptacle 28 and a threaded rod 44 is screwed therethrough (See FIG. 2) by turning knob 40.

Figure 5:
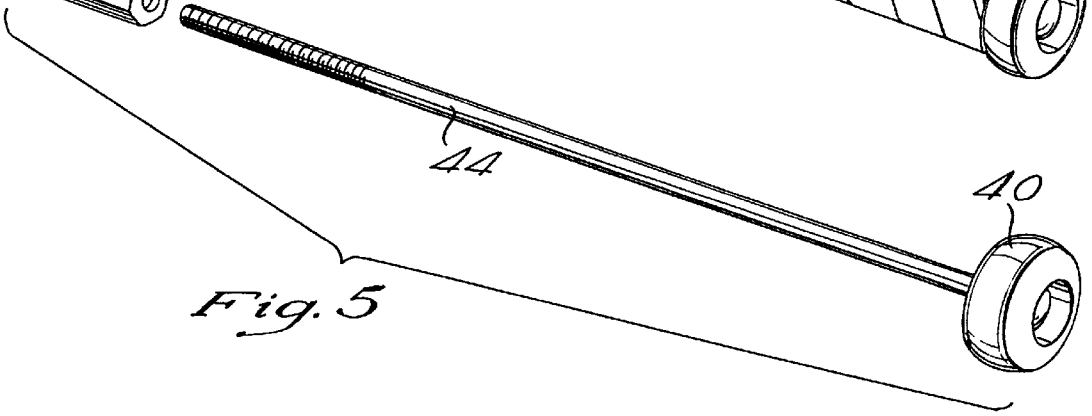
FIG. 5 is an isometric view of the knob controlled locking rod and nut.

Guide bearing-like members 46 are located at spaced intervals in channel 34 and ahead of the receptacle 28 in channel 24. The members 46 maintain the alignment of the rod 44 through both portions 20 and 32. This knob-rod-nut assembly is best shown in FIG. 5.

Figure 3:
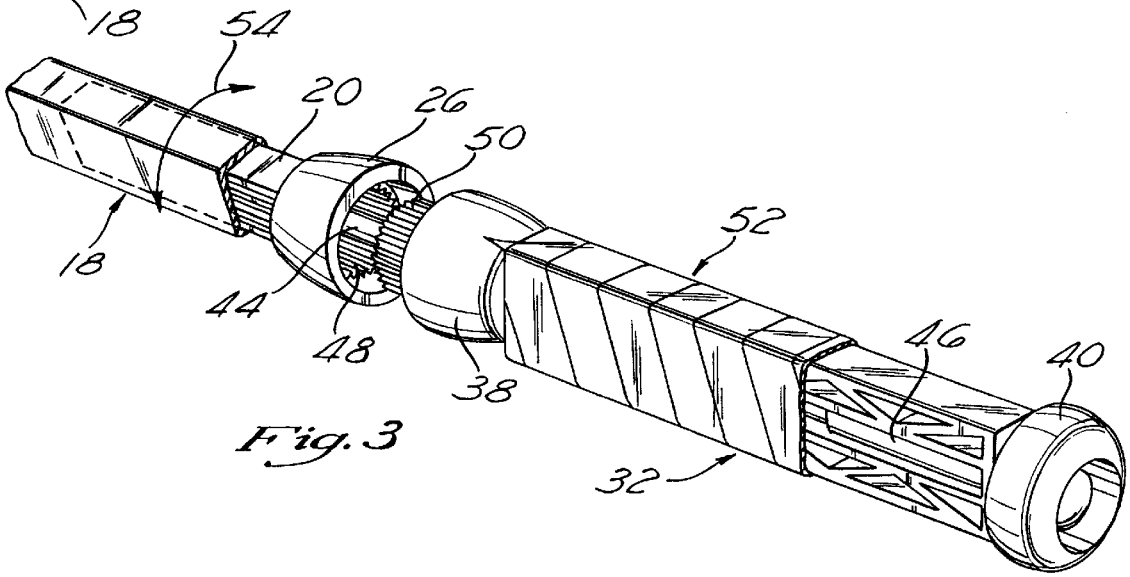
FIG. 3 is a mirror image of FIG. 2.
Figure 4:
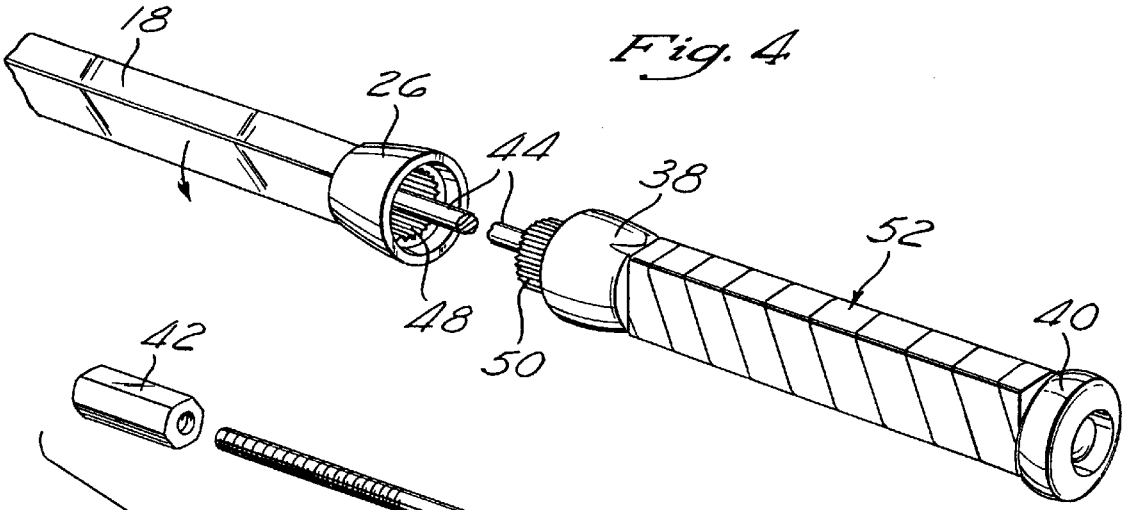
FIG. 4 is another exploded isometric view of the handle just prior to final assembly of its two major portions.
Figure 6:
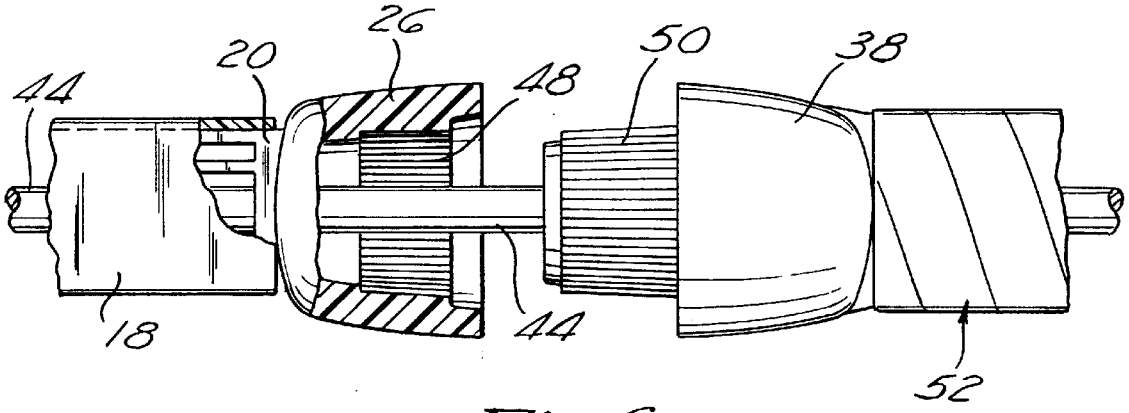
FIG. 6 is a broken cross-sectional view of the handle constructed in accordance with this invention at the point of juncture of the two portions thereof.

As may be seen with reference to FIGS. 3, 4 and 6 the bell shaped housing 26 is provided with internal splines tapered pilots tapered to increments 48 and the bell shaped housing

26 is provided with a tapered pilot and tapered splined extension 50 that will be drawn into the splined area 48 by the rotation of the knob 40 on drawing the portions 20 and 32 together.

The handle 16 is completed by wrapping tape 52 about portion 32 to facilitate gripping thereof.

Having set forth the manor of construction of a preferred embodiment of this invention, it is now desired to provide the reader hereof with a brief description of its operation. Simply stated, a hockey player 10 will grip the hockey stick with one hand on the shaft 14 and another on the handle 16 above the tape 52. Upon rotation of knob 40 the player 10 will be able to align the stick to their particular wrist characteristics to more naturally align their back, shoulders and forearms and place the back perfectly perpendicular to the surface with the least amount of body contortion (See FIGS. 1 and 3). Once the player has the desired angle for his or her blade relative to the underlying surface, the player reverses the rotation of knob 40 to ratchet the splines 50 and 48 together again locking the handle and blade-shaft element together. It should be noted that the length of the threaded rod 40 is such as to prevent separation of portion 32 from portion 20 during this process.

It is now desired to conclude with a set of appended claims that will embrace not only the preferred embodiment set forth herein but all changes and modifications thereto within the spirit and scope of this invention.

What is claimed is:

1. A hockey stick having a blade and shaft element and a handle connected thereto, said handle comprising:

a spline connection to adjustably connect said handle with said blade and shaft element; and a locking means to maintain the aforesaid spline connection and permit its release for opening and closing the angle of the blade and shaft relative to the orientation of the handle.

2. A hockey stick comprising:

a blade having a beveled edge and a curvature from heel to toe;

a shaft integral with the heel of the blade and extending upwardly for gripping by a hockey player, said shaft terminating at its uppermost end in a hollow portion;

a handle having a first portion comprised of a surface area at one end thereof for insertion into and connection with the hollow end of said shaft and at its other end terminating in a bell housing with an internally splined area, and a second portion having an elongated area extending from a bell housing with an externally splined surface for mating with the internally splined surface of the first portion, said first and second portions having interior channels with a fastening means at one end of the channel in the first portion; and means inserted into said channels of the first and second portions from an end of the elongated area of the second portion and through the fastening means to draw together and release said first and second portions splined surfaces in facilitation of rotation said shaft and angular orientation of said blade integral therewith.

* * * * *